US010150607B2

(12) United States Patent
Bates et al.

(10) Patent No.: US 10,150,607 B2
(45) Date of Patent: Dec. 11, 2018

(54) ADHESIVE PACKAGING SYSTEM WITH MEMBRANE

(71) Applicant: Royal Adhesives and Sealants, LLC, South Bend, IN (US)

(72) Inventors: Justin Bates, Clark Lake, MI (US); Ronald Vollmer, Chelsea, MI (US)

(73) Assignee: ROYAL ADHESIVES AND SEALANTS LLC, South Bend, IN (US)

( * ) Notice: Subject to any disclaimer, the term of this patent is extended or adjusted under 35 U.S.C. 154(b) by 0 days.

(21) Appl. No.: 14/535,988

(22) Filed: Nov. 7, 2014

(65) Prior Publication Data

US 2015/0129615 A1 May 14, 2015

Related U.S. Application Data

(60) Provisional application No. 61/903,711, filed on Nov. 13, 2013.

(51) Int. Cl.

| | |
|---|---|
| ***B01F 5/06*** | (2006.01) |
| ***B65D 81/32*** | (2006.01) |
| *B05C 17/005* | (2006.01) |
| *B01F 15/00* | (2006.01) |

(52) U.S. Cl.

CPC ..... *B65D 81/325* (2013.01); *B01F 5/0614* (2013.01); *B01F 15/0087* (2013.01); *B05C 17/00553* (2013.01)

(58) Field of Classification Search

CPC ..... B65D 81/325; B05C 17/00586; B05C 17/00553; B01F 5/0614; B01F 15/0087

See application file for complete search history.

(56) References Cited

U.S. PATENT DOCUMENTS

| | | | | |
|---|---|---|---|---|
| 2,025,747 | A | | 12/1935 | Hothersall |
| 2,106,577 | A | * | 1/1938 | Sherbondy ..... B65D 83/0005 206/384 |
| 2,679,331 | A | | 5/1954 | Stoneman et al. |
| 3,071,294 | A | * | 1/1963 | Galbierz ..... B05C 17/005 222/327 |
| 3,166,221 | A | | 1/1965 | Nielsen |
| 3,363,811 | A | * | 1/1968 | Geist, Sr. ..... B05C 17/00506 222/541.1 |
| 3,746,216 | A | | 7/1973 | Frederick |
| 4,510,298 | A | * | 4/1985 | Lindsey ..... C08F 6/006 526/312 |
| 4,676,657 | A | | 6/1987 | Botrie |
| 4,771,919 | A | | 9/1988 | Ernst |
| 4,846,373 | A | * | 7/1989 | Penn ..... B05C 17/00516 222/137 |
| 4,869,400 | A | | 9/1989 | Jacobs |
| 4,994,540 | A | | 2/1991 | Boerner et al. |

(Continued)

*Primary Examiner* — Patrick M Buechner

(74) *Attorney, Agent, or Firm* — Benesch, Friedlander, Coplan & Aronoff LLP

(57) ABSTRACT

A two part adhesive packaging system is provided. The packaging system includes two containers for holding a two-part adhesive. The packaging system further includes a connector having two ports for communicating with the containers. A mixing nozzle is attachable to the containers. The mixing nozzle includes a membrane disposed therein. The membrane is configured to break upon application of a sufficient force thereon, such as by pumping or pushing the two-part adhesive from the containers.

15 Claims, 5 Drawing Sheets

(56) References Cited

U.S. PATENT DOCUMENTS

| | | | | |
|---|---|---|---|---|
| 5,033,650 | A * | 7/1991 | Colin | A61C 5/062 222/137 |
| 5,104,005 | A | 4/1992 | Schneider | |
| 6,302,574 | B1 * | 10/2001 | Chan | A61B 17/8825 222/137 |
| 6,409,972 | B1 | 6/2002 | Chan | |
| 6,752,292 | B2 | 6/2004 | Van Herpen | |
| 7,056,556 | B2 | 6/2006 | Burns | |
| 7,318,554 | B2 | 1/2008 | Langeman | |
| 7,337,928 | B2 | 3/2008 | Jackman | |
| 7,661,565 | B2 | 2/2010 | Jackman | |
| 8,684,233 | B2 * | 4/2014 | Nishio | B65D 81/3288 222/1 |
| 2011/0084094 | A1 | 4/2011 | Reidt et al. | |
| 2011/0198370 | A1 * | 8/2011 | Ho | B01F 5/0615 222/137 |

* cited by examiner

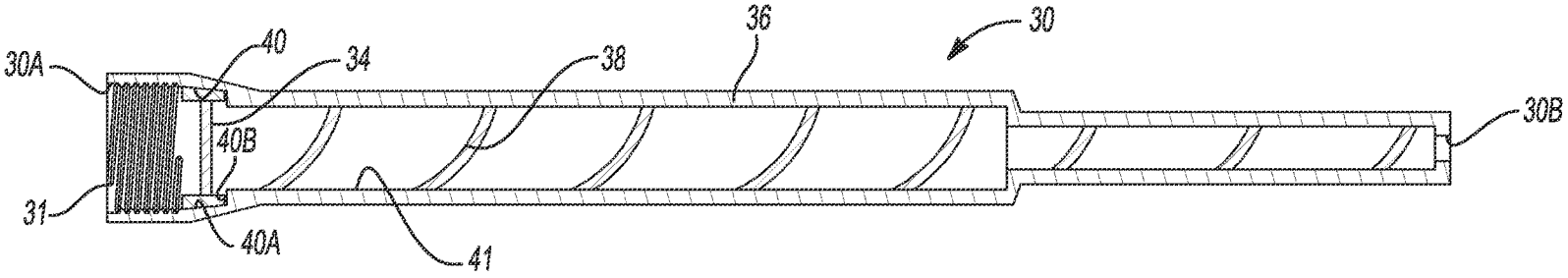
Fig-4
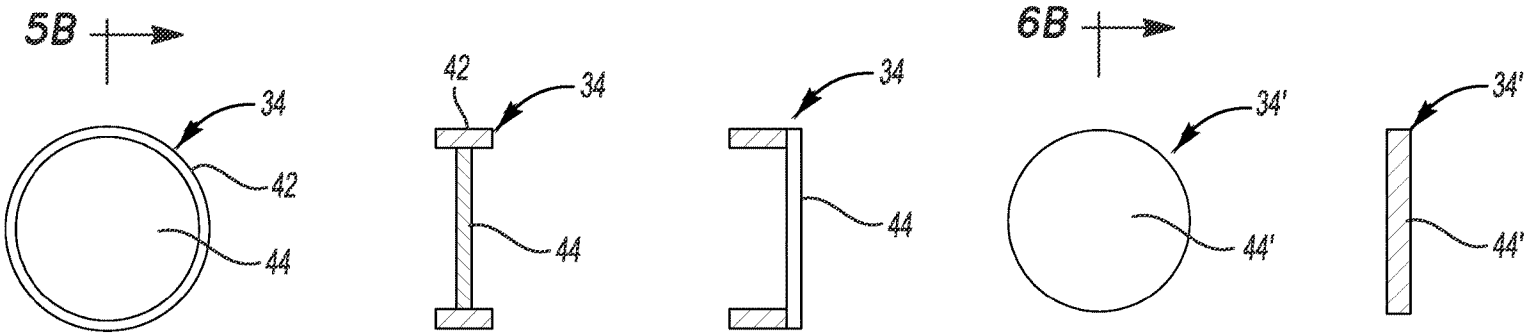
Fig-5A
Fig-5B
Fig-5C
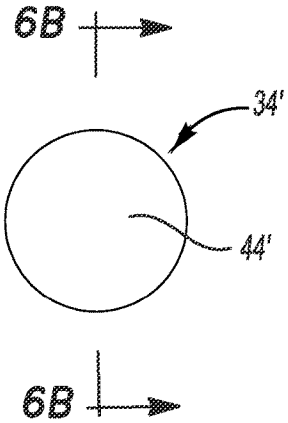
Fig-6A
Fig-6B

ADHESIVE PACKAGING SYSTEM WITH MEMBRANE

CROSS-REFERENCE TO RELATED APPLICATIONS

This application claims the benefit of U.S. Provisional Application No. 61/903,711 filed Nov. 13, 2013. The disclosure of the above application is incorporated herein by reference.

FIELD

The present invention relates to an adhesive packaging system used in dispensing a two-part adhesive onto a roofing substrate, and more particularly to an adhesive or sealant packaging system having a protective membrane to prevent premature mixing of the two-part adhesive or sealant.

BACKGROUND

In many roofing applications, for example in large, flat commercial roof decks, a roofing membrane is used to seal and protect the roof deck from environmental weather conditions. The roofing membrane may be made of various materials, such as polymeric materials including EPDM (ethylene propylene diene M-rubber) or TPO (thermoplastic polyolefin). The roofing membrane is adhered overtop insulation boards or cover boards. The insulation boards are typically secured to the roofing substrate or roof deck via an adhesive composition. A conventional adhesive composition used to adhere the insulation boards to the roof deck, or used to adhere roofing membranes to rigid insulation boards, cover boards, or directly to the roof deck, includes polyurethane. The polyurethane adhesives are oftentimes applied directly onto the roof deck via an applicator system and the insulation boards are then laid onto the roof deck surface. Conventional polyurethane adhesives oftentimes include two separate parts that are mixed by an applicator just prior to being applied onto the surface of the roof deck. The two parts include an isocyanate blend and a polyol blend. Upon mixing, the isocyanate blend reacts or crosslinks with the polyol blend to form the polyurethane adhesive.

These conventional two-part polyurethane adhesives must be packaged into separate containers to prevent mixing of the adhesive parts prior to application. In certain configurations, the adhesive parts are packaged into a single system having divided, separately sealed sides for storing the adhesive parts. Upon removal of a port cap, the adhesive sides communicate with an attached nozzle. However, if the nozzle is attached and then stored, it is possible for the adhesive parts to drain into the nozzle prior to application, crosslink, and plug the nozzle or the package with cured polyurethane. One solution is to place a membrane overtop the port but underneath the port cap. However, this membrane may become ruptured or pierced during shipping and handling or during removal of the port cap, thus defeating the purpose of the membrane. In other cartridge configurations, plugs are inserted into the ports or molded over the ports to seal the contents of the cartridge during storage and transportation. Prior to application the plugs are removed and the mixing nozzle is attached. Therefore is also possible for adhesive components to prematurely dispense and mix if the cartridge and mixing nozzle are stored with the plugs removed. Therefore, there is a need in the art to provide an adhesive packaging system that prevents unwanted mixing of the adhesive parts prior to application on a substrate, but after the attachment of the mixing nozzle, and allows for the use of port caps, port plugs, or both without rupturing the membrane.

SUMMARY

A two part adhesive packaging system is provided. The packaging system includes two containers for holding a two-part adhesive. The packaging system further includes a connector having two ports for communicating with the containers. A removable cap is placed overtop the two ports. In one embodiment, plugs (not shown) are inserted into the two ports. When the cap is removed, a membrane is disposed overtop the ports to prevent the two-part adhesive from draining from the containers. The membrane may be attached to a mixing nozzle that replaces the cap or alternatively may be attached overtop the ports once the cap has been removed. The membrane is configured to break upon application of a sufficient force thereon, such as by pumping or pushing the two-part adhesive from the containers.

For example, a system for storing and mixing a first part and a second part of a two-part adhesive includes a cartridge having a first container that defines a first space for storing the first part of the adhesive, a second container that defines a second space for storing the second part of the adhesive and connected to the first container, a connector connected to the first container and the second container, a first port disposed in the connector and in communication with the first space, and a second port disposed in the connector and in communication with the second space. A mixing nozzle having an attachment portion is removably connected to the connector of the cartridge. The mixing nozzle has a mixing portion for mixing the first part with the second part and a membrane disposed between the attachment portion and the mixing portion.

In one aspect, the membrane is ruptured by the first part or the second part of the adhesive when the first part or the second part of the adhesive is forced out of the first space and the second space.

In another aspect, the membrane includes a ring and a membrane cover connected to the ring.

In another aspect, the membrane cover is adhered to an inner diameter of the ring.

In another aspect, the membrane cover is adhered to a side of the ring and has a diameter approximately equal to an outer diameter of the ring.

In another aspect, the ring has an inner diameter that is greater than the outer diameter of the connector and has an axial thickness that allows the membrane cover to sit flush with a planar surface of the connector.

In another aspect, the attachment portion includes a connection feature disposed on an inner surface that engages a connection feature on the connector, and wherein the ring has an outer diameter that fits between the connection feature of the attachment portion.

In another aspect, the mixing portion includes an inner surface that defines an annular groove, and the ring is disposed within the annular groove.

In another aspect, the annular groove is defined by an axial surface and a radial surface.

In another aspect, the ring is made from a rigid material and the membrane cover is made from a rupturable material.

In another aspect, the membrane is disc shaped and adhered along a periphery of the inner surface of the mixing portion and covers the first port and the second port.

In another aspect, a first piston is disposed in the first space and a second piston is disposed in the second space, and wherein the pistons move to push the first part and the second part out through the first port and the second port to rupture the membrane and enter the mixing portion.

In another aspect, the first piston is in contact with the first part and the second piston is in contact with the second part.

In another aspect, the membrane is attached to an outside portion of the cartridge, and wherein the membrane is folded overtop the connector to cover the first and second ports between the connector and the mixing nozzle.

Further features, aspects and advantages of the present invention will become apparent by reference to the following description and appended drawings wherein like reference numbers refer to the same component, element or feature.

DRAWING DESCRIPTION

The drawings described herein are for illustration purposes only and are not intended to limit the scope of the present disclosure in any way.

FIG. 4 is a cross-section view of the mixing nozzle shown shown in FIG. 3;

FIG. 5A is an end view of a membrane used in the mixing nozzle;

FIG. 5B is a cross section view of the membrane viewed in the direction of arrow 5B-5B shown in FIG. 5A in accordance to one embodiment;

FIG. 5C is a cross section view of the membrane viewed in the direction of arrow 5B-5B shown in FIG. 5A in accordance to another embodiment.

FIG. 6A is an end view of another membrane used in the mixing nozzle;

FIG. 6B is a cross section view of the membrane viewed in the direction of arrow 6B-6B shown in FIG. 6A;

DETAILED DESCRIPTION

The following description is merely exemplary in nature and is not intended to limit the present disclosure, application, or uses.

Figure 2:
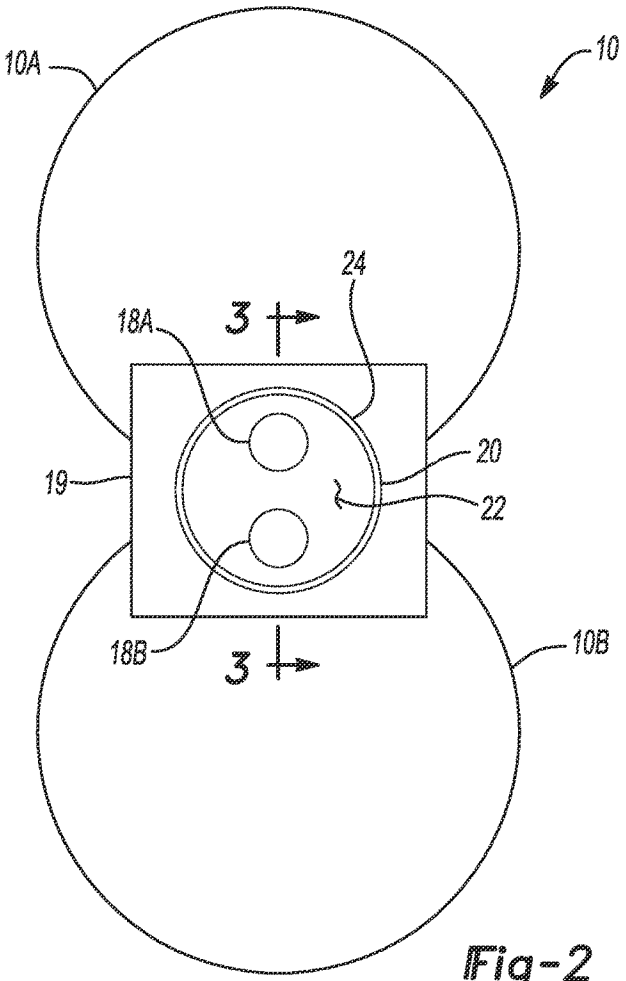
FIG. 2 is a top view of the packaging system shown in FIG. 1 with a cap removed.
Figure 1:
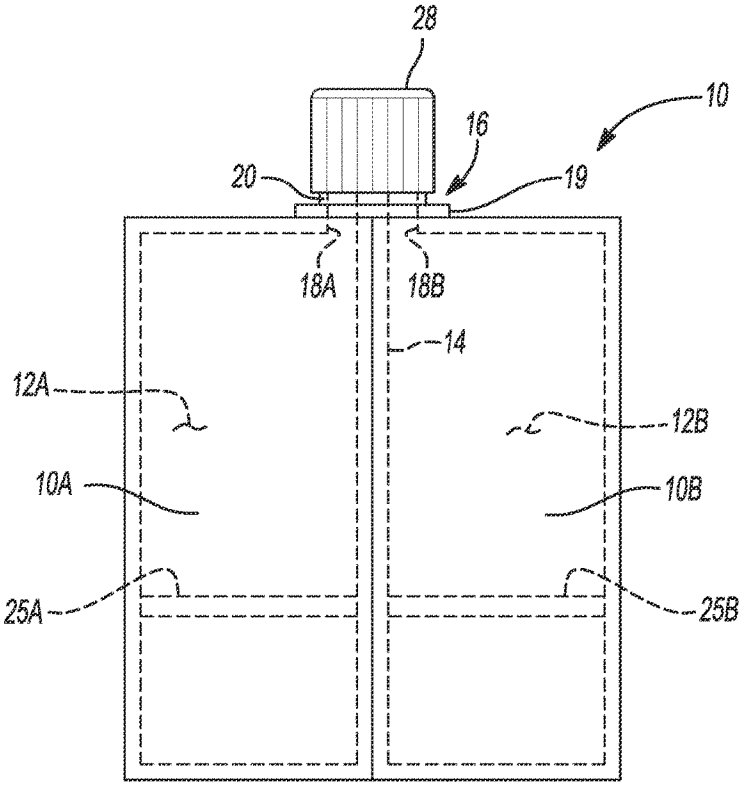
FIG. 1 is a side view of a packaging system according to the principles of the present invention.

Referring to FIGS. 1 and 2, a packaging system or cartridge for a two-part adhesive illustrated and generally indicated by reference number 10. The packaging system 10 is configured to store two separate components or parts of a two-part adhesive compound. For example, the two-part adhesive is a polyurethane adhesive for use on roofing substrates. Prior to mixing, the adhesive is comprised of two separate parts including an isocyanate blend and a polyol blend. The packaging system 10 includes an "A" side container 10A attached to a "B" side container 10B. Each of the containers 10A and 10B define a storage space 12A and 12B, respectively. Each space 12A and 12B stores a different part of the two-part adhesive compound. The spaces 12A and 12B are separated from one another by an interior wall 14 in order to prevent mixing of the parts prior to application of the adhesive on a substrate. In one example, the containers 10A and 10B are each generally cylindrical and are formed from a single molded body, though it should be appreciated that the containers 10A and 10B may have other shapes and be made from separately formed, attached components without departing from the scope of the present invention.

The packaging system 10 includes an outlet 16 located on an end of the containers 10A and 10B. The outlet 16 includes an "A" side port 18A and a "B" side port 18B that communicate with the spaces 12A and 12B, respectively. The ports 18A and 18B are configured to allow the parts of the adhesive compound stored in the packaging system 10 to be pumped, pushed, or otherwise forced out of the containers 10A and 10B. For example, where the adhesive compound is pushed out of the packaging system 10, the packaging system 10 includes a piston 25A disposed in an open end of the container 10A and a piston 25B disposed in an end of the container 10B. The pistons 25A and 25B are in contact with the contents of the containers 10A and 10B, respectively. The pistons 25A and 25B may be separate pieces or connected. Pushing the pistons 25A and 25B forces the adhesive compound out of the packaging system 10 as described below.

The ports 18A and 18B communicate from the spaces 12A and 12B, respectively, through a base 19 and a connector 20. In one embodiment, plugs (not shown) are removably inserted into the two ports 18A and 18B. The base 19 is a square or rectangular portion disposed overtop an end of the containers 10A and 10B opposite the pistons 25A and 25B. The connector 20 is a cylindrical extension that includes a flat or planar top surface 22 and a threaded side surface 24. It should be appreciated that the side surface 24 may include other kinds of connection features in addition to or in place of threads, such as lips or grooves, without departing from the scope of the present invention. The planar top surface 22 is preferably completely flat. A cap 28 is removably attached to the connector 20 via mating threads (not shown) complementary to the threaded side surface 24. The cap 28 securely fits overtop the connector 20 to cover the ports 18A and 18B during shipment, storage, etc.

Figure 3:
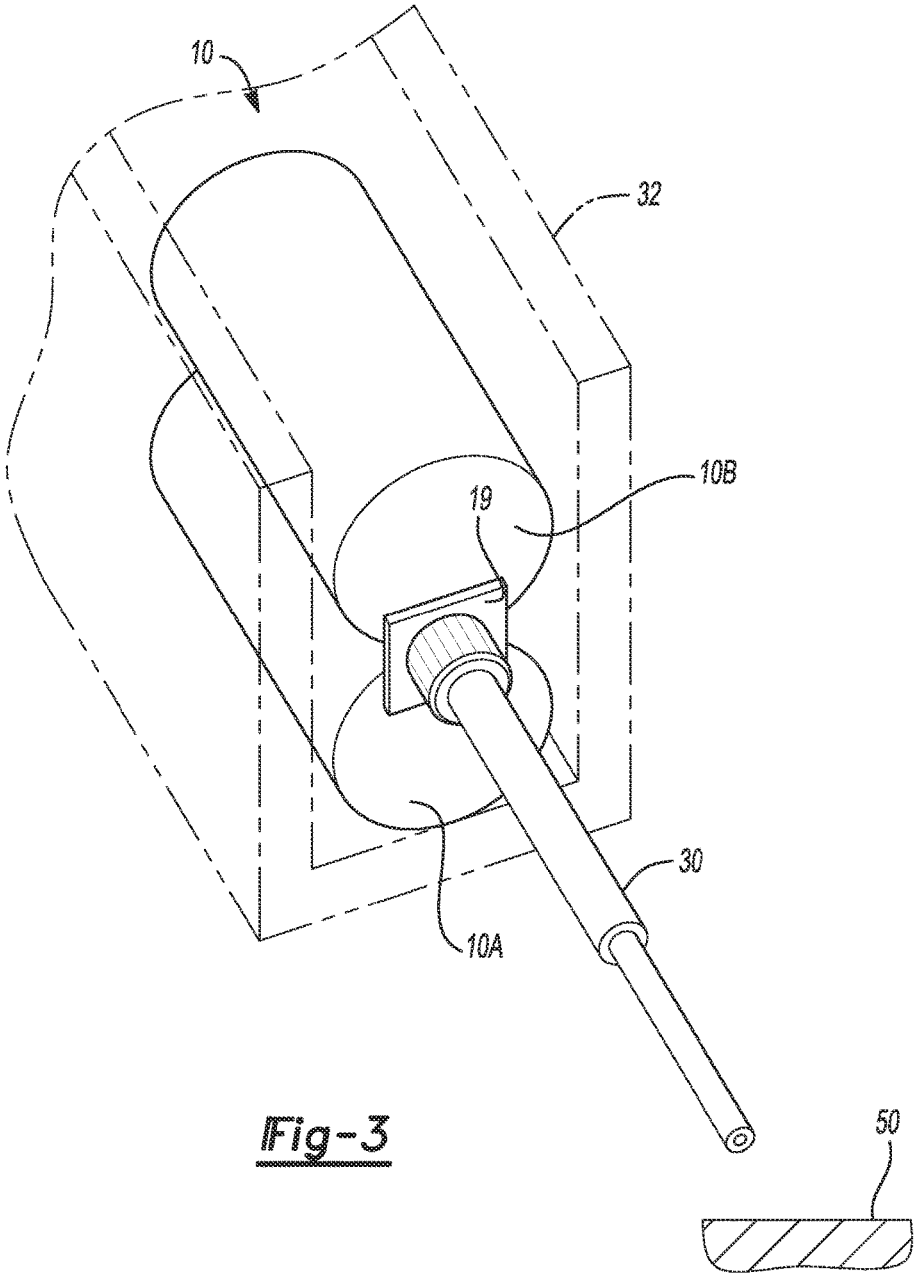
FIG. 3 is a perspective view of the packaging system with a mixing nozzle shown in an exemplary applicator device.

Turning to FIGS. 3 and 4, prior to application of the adhesive, the cap 28 (or plugs) is removed from the adhesive system 10 thereby exposing the connector 20. An applicator or mixing nozzle 30 is then attached to the connector 20 via mating threads 31 complementary to the threaded side surface 24. The mixing nozzle 30 is an extended member that mixes the "A" side fluid with the "B" side fluid. The mixing nozzle 30 is disposable and is preferably an element, static mixing nozzle, though it should be appreciated that other types and grades of mixers may be employed without departing from the scope of the present invention.

The packaging system 10 and attached mixing nozzle 30 are then loaded into an applicator device 32. An exemplary applicator device is disclosed in commonly owned U.S. Pat. No. 7,056,556, hereby incorporated by reference. It should be appreciated that any other number of applicator devices such as pneumatic single-bead applicators, battery powered single-bead applicators, manual applicators, among other devices may be employed without departing from the scope of the present invention. Contractors often are required to pre-attach the mixing nozzle 30 to the packaging system 10 to efficiently stage a job. Once pre-staged, job interruptions such as rainstorms can occur. Isocyanates, commonly used in 2-part polyurethane adhesives are moisture sensitive and rainwater dripping into a mixing nozzle can cause a chemical reaction to occur. Likewise, pre-staged jobs left overnight can suffer from dew forming in the mixing nozzle and causing reaction of the isocyanate. In addition, contractors often load the cartridges into equipment and then must pause while they wait for obstructions to be removed from the path of intended adhesive application. This is especially an issue for low-viscosity adhesive formulas for applications such as membrane attachment that can be problematic due to how fast the low-viscosity adhesives run into the mixing nozzle 30 when loaded into the applicator 32. In order to prevent premature mixing or spills, the mixing nozzle 30 includes a membrane 34. For example, with reference to FIG. 4, the mixing nozzle 30 includes a first end or attachment portion 30A and an opposite, second end or nozzle 30B. The first end 30A includes the internal threads 31 that are complementary with the threads 24 on the connector 20. Between the first end 30A and the second end 30B is an extended tube portion or mixing portion 36. A static mixing element or a helical mixing member 38 is preferably disposed within the tube portion 36. The mixing member 38 aids in the mixing of the A part and B part of the polyurethane prior to dispensing from the second end 30B. The membrane 34 is preferably disposed between the attachment portion 30A and the tube portion 36, and preferably between the threads 31 and the mixing member 38. For example, the tube portion 36 may include an annular groove 40 formed in an inner surface 41 of the tubular portion 36. The annular groove 40 receives the membrane 34 therein. In the example provided, the annular groove 40 is defined by an annular surface 41A and a step, radial surface 41B.

Turning to FIGS. 5A, 5B and 5C, the membrane 34 preferably includes a support ring 42 and a membrane cover 44 connected to an inner diameter of the support ring 42 (shown in FIG. 5B). The support ring 42 is preferably a rigid material such as a plastic, metal, or paper/cardboard. The support ring 42 is disposed within the groove 40 and contacts the step surface 40B to prevent the membrane 34 from moving axially along the length of the tubular portion 36 of the mixing nozzle 30. The support ring 42 dimensions are functions of the inner diameter of the threads 31, the size of the annular groove 40, and the outer diameter and a height 'h' of the connector 20 (shown in FIG. 7A). For example, the support ring 42 preferably has an outer diameter that fits inside or between consecutive threads 31 so that the support ring 42 is seated within the annular groove 40. The support ring 42 also has an inner diameter and axial thickness that is greater than the outer diameter of the connector 20 and has a thickness that allows the membrane cover 44 to sit flush with the planar surface of the connector 20. In one example, the outer diameter of the connector 20 is 0.675", the height h of the connector 20 is 0.225", the inner diameter of the thread is 0.828", the inner diameter of the annular groove is 0.658", and therefore the support ring 42 has an inner diameter of 0.68", an outer diameter of 0.8", and a thickness of 0.23". The membrane cover 44 is preferably a light gauge foil, a plastic coated foil, or laminates of paper, foil, and/or plastics that are adhered to the inner radius of the support ring 42. Alternatively, the membrane cover 44 is adhered to a side or end surface of the support ring 42, as shown in FIG. 5C, and has a diameter substantially equal to the outer diameter of the support ring 42. In one example, the membrane cover 44 is comprised of aluminum foil having a thickness of 1.5 mil (0.038 mm) and ruptures at approximately 33 psi. In another example, the membrane cover 44 is comprised of aluminum foil having a thickness of 2.5 mil (0.064 mm) and ruptures at approximately 71 psi. However, if the aluminum foil is too thin, the membrane cover 44 can rupture prematurely when the mixing nozzle 30 is attached to the connector 20. For example, a membrane cover 44 comprised of aluminum foil having a thickness of 1.0 mil (0.025 mm) ruptures at approximately 11.5 psi, a pressure too low for the intended use. Turning to FIGS. 6A and 6B, an alternate membrane 34' is shown. The membrane 34' comprises a disc shaped membrane cover 44'. The membrane cover 44' is a light gauge foil, a plastic coated foil, or laminates of paper, foil, and/or plastics that is adhered along an outer periphery to the inner surface 41 of the tubular portion 36 within the groove 40.

Returning to FIGS. 1-4, the membrane 34 prevents the adhesive parts from draining through the ports 18A and 18B when stored without the cap 28 or plugs thereby preventing the adhesive parts from mixing prematurely in the applicator 20 or mixing nozzle 30. When pressure below a threshold or breaking or rupture pressure is applied to the membrane 34, the support ring 42 seals against the step portion 40B thereby preventing fluid from exiting the ports 18A and 18B. Some adhesives are formulated with substantially different viscosities in the polyol and isocyanate portions. In this case the lower viscosity portion tends to gravity feed into the mixing nozzle prior to the mechanical operation of the equipment causing an off-ratio adhesive mix during the initial dispense. The off-ratio adhesive may not perform as expected. Using the mixing nozzle 30 with the membrane 34, the packaging system 10 may then be installed and stored in the device 32 without the mixing nozzle 30 becoming blocked due to the adhesive components crosslinking in the mixing nozzle 30 or without off-ratio initial dispenses or without messy adhesive draining through the mixing nozzle 30.

To apply the adhesive, the device 32 pumps, pushes, or otherwise forces the components out of the packaging system 10. The components create a pressure on the membrane cover 44 greater than the threshold or breaking pressure which ruptures or breaks the membrane cover 44, thereby allowing the components to enter the helical mixing member 38. The threshold or breaking pressure is set to allow the membrane cover 44 to rupture before the pressure in the containers 10A and 10B builds such that the components leak out of the back sides of the containers 10A and 10B. The helical mixing member 38 mixes the A and B side components and the combined fluid exits the mixing nozzle 30 at the second end 30B and is dispensed in the form of elongated beads on a substrate 50. The mixed compound then cures and forms an adhesive.

Figure 7B:
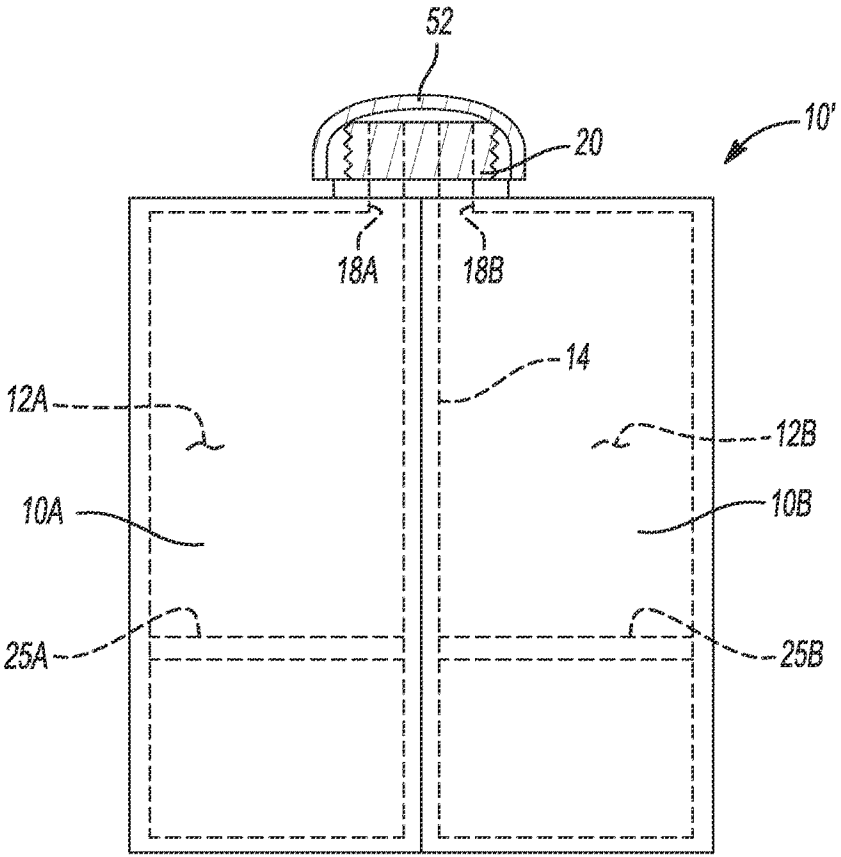
FIG. 7B is a side view of the alternate packaging system with a membrane in a cover position.
Figure 7A:
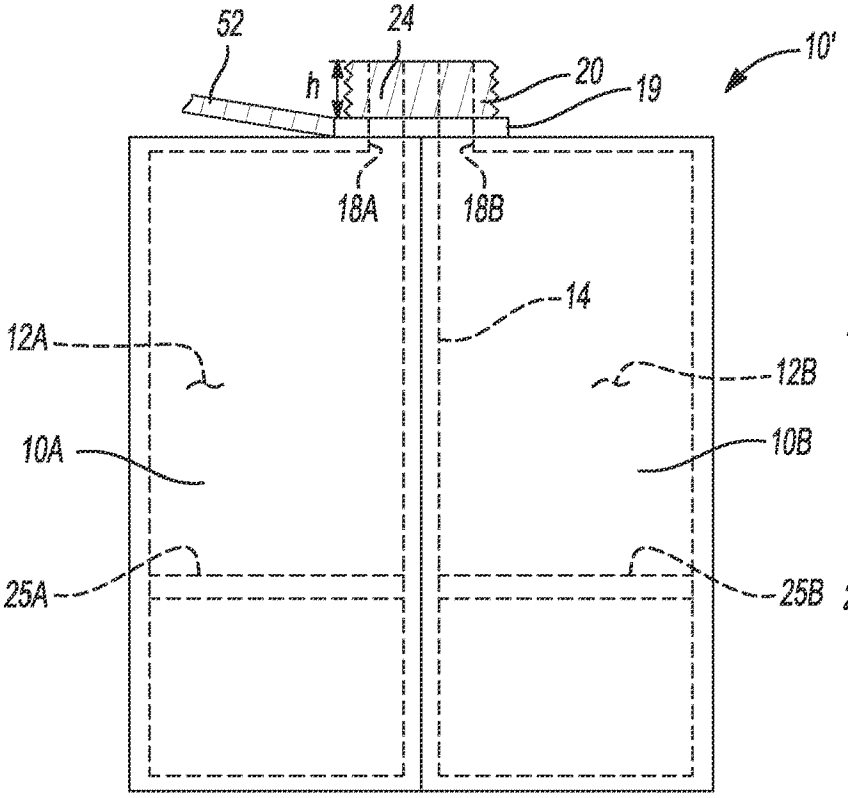
FIG. 7A is a side view of an alternate packaging system according to the principles of the present invention.
Figure 7C:
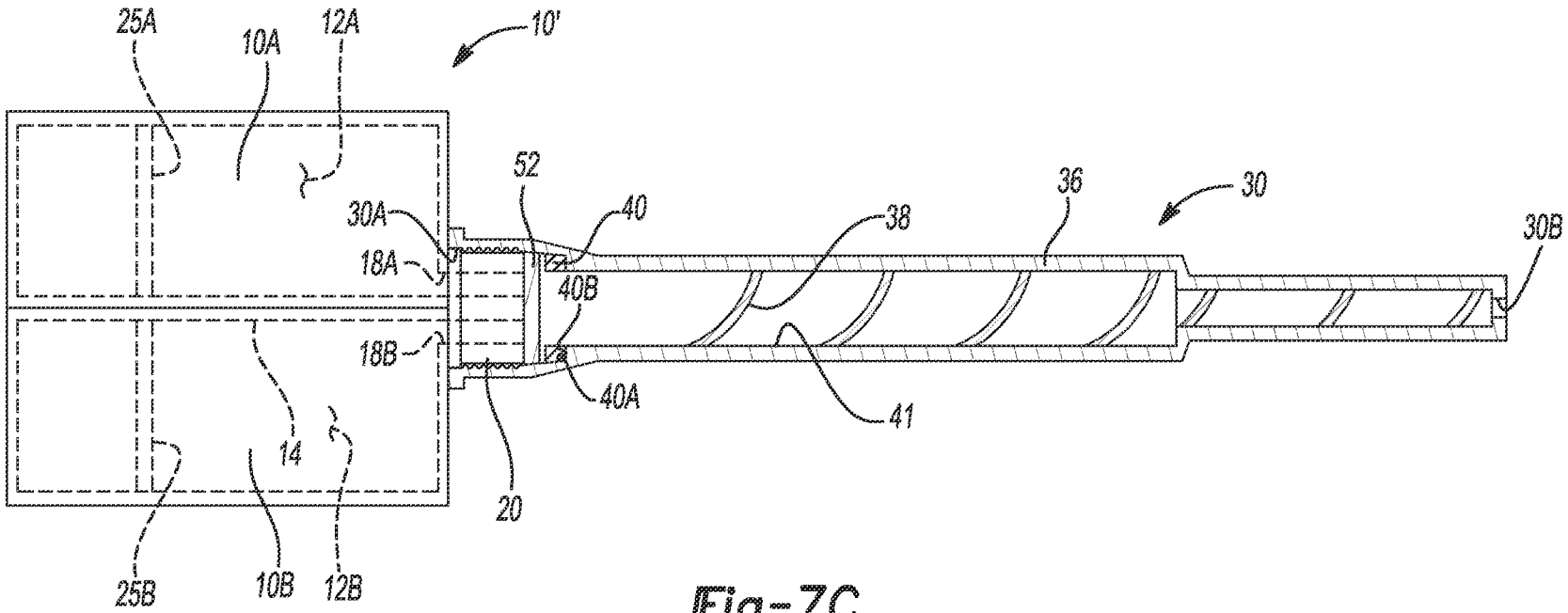
FIG. 7C is a side view of the alternate packaging system with an attached mixing nozzle.

Turning to FIGS. 7A and 7B, and alternate embodiment of a packaging system is generally indicated by reference number 10'. The packaging system 10' is similar to the packaging system 10 and like components are indicated by like reference numbers. However, the packaging system 10' includes a membrane flap 52 attached to the packaging system 10'. The membrane flap 52 is preferably a resilient, flexible material such as a foil, a plastic coated foil, or laminates of paper, foil, and/or plastics. The membrane flap 52 is preferably adhered or crimped to the base 19 between the containers 10A and 10B and the connector 20. When the cap 28 is removed, the membrane flap 52 is folded overtop the connector 20 to cover the ports 18A and 18B, as seen in FIG. 7B. The membrane flap 52 is sufficiently large enough to cover the ports 18A and 18B when folded over the connector 20 and may have various shapes. The mixing nozzle 30 is then attached to the connector 20 overtop the membrane flap 52, either by threads or a snap fit connection, shown in FIG. 7C. The membrane flap 52 seals the ports 18A and 18B. To apply the adhesive, the device 32 pumps, pushes, or otherwise forces the components out of the packaging system 10'. The components create a pressure on the membrane 52 greater than a threshold or breaking pressure which ruptures or breaks the membrane 52, thereby allowing the components to enter the helical mixing member 38.

The description of the invention is merely exemplary in nature and variations that do not depart from the gist of the invention are intended to be within the scope of the invention. Such variations are not to be regarded as a departure from the spirit and scope of the invention.

The following is claimed:

1. A system for storing and mixing a first part and a second part of a two-part adhesive, the system comprising:

a cartridge, and a mixing nozzle that is removably connected to the cartridge, wherein the cartridge has a first container that defines a first space for storing the first part of the adhesive, a second container that defines a second space for storing the second part of the adhesive and connected to the first container, a connector connected to the first container and the second container, a first port disposed in the connector and in communication with the first space, and a second port disposed in the connector and in communication with the second space; and wherein the mixing nozzle comprises, an attachment portion that is configured to be removably connected to the connector of the cartridge, a mixing portion, and a rupturable membrane that is attached to the mixing nozzle and disposed between the attachment portion of the nozzle and the mixing portion of the nozzle.

2. The system of claim 1, wherein the rupturable membrane is configured to be ruptured by the first part or the second part of the adhesive when the first part or the second part of the adhesive is forced out of the first space and the second space.

3. The system of claim 1, wherein the rupturable membrane comprises a support ring and a membrane cover, and wherein the membrane cover is adhered to an inner diameter of the support ring in order to form the rupturable membrane.

4. The system of claim 1, wherein the rupturable membrane comprises a support ring and a membrane cover, and wherein the membrane cover is adhered to an outer side surface of the support ring in order to form the rupturable membrane and wherein the membrane cover has a diameter approximately equal to an outer diameter of the support ring.

5. The system of claim 1, wherein the rupturable membrane is disc shaped and adhered along a periphery of the inner surface of the mixing portion and covers the first port and the second port.

6. The system of claim 1, wherein the rupturable membrane comprises a support ring and a membrane cover, and wherein the support ring has an inner diameter that is greater than an outer diameter of the connector and has an axial thickness that allows the membrane cover to sit flush with a planar surface of the connector.

7. The system of claim 6, wherein the attachment portion includes a connection feature disposed on an inner surface that engages a connection feature on the connector, and wherein the support ring has an outer diameter that fits between the connection feature of the attachment portion.

8. The system of claim 3 wherein the mixing portion of the mixing nozzle includes an inner surface that defines an annular groove, and wherein the support ring is disposed within the annular groove in order to attach the rupturable membrane to the mixing nozzle.

9. The system of claim 8 wherein the annular groove is defined by an axial surface and a radial surface.

10. The system of claim 8 wherein the support ring is made from a rigid material.

11. The system of claim 1 further comprising a first piston disposed in the first space and a second piston disposed in the second space, and wherein the pistons move to push the first part and the second part out through the first port and the second port to rupture the rupturable membrane and enter the mixing portion.

12. The system of claim 11 wherein the first piston is in contact with the first part and the second piston is in contact with the second part.

13. A system comprising:

a cartridge having a first container that defines a first space, a second container that defines a second space, wherein the second container is connected to the first container, a connector connected to the first container and the second container, a first port disposed in the connector and in communication with the first space, a second port disposed in the connector and in communication with the second space;

a polyol disposed within the first space;

an isocyanate disposed within the second space; and a mixing nozzle comprising an attachment portion that is configured to be removably connected to the connector of the cartridge, a mixing portion, and a membrane that is attached to the mixing nozzle and disposed between the attachment portion of the nozzle and the mixing portion of the nozzle, and wherein the membrane includes a support ring and a membrane cover that is rupturable, and wherein the membrane cover is connected to the inner diameter of the support ring to form the membrane, wherein the membrane is configured to seal the first port and the second port, and wherein the membrane is configured to be ruptured by the polyol or the isocyanate when the polyol or the isocyanate is forced out of the first space and the second space at a pressure greater than a threshold pressure.

14. The system of claim 13 wherein the mixing nozzle includes an inner surface that defines an annular groove, and wherein the support ring is disposed within the annular groove in order to attach the membrane to the mixing nozzle.

15. The system of claim 14 wherein an outer diameter, inner diameter, and axial thickness of the support ring is a function of an inner diameter of the attachment portion, the annular groove, and an outer diameter and height of the connector.

* * * * *